US006691475B1

(12) United States Patent
Tiongco et al.

(10) Patent No.: US 6,691,475 B1
(45) Date of Patent: Feb. 17, 2004

(54) TRAVELER'S ACCOMMODATION

(75) Inventors: Antonio L. Tiongco, Linton, IN (US); Alfred R. Talens, Terre Haute, IN (US)

(73) Assignee: Fast Break Inn, Linton, IN (US)

( * ) Notice: Subject to any disclaimer, the term of this patent is extended or adjusted under 35 U.S.C. 154(b) by 0 days.

(21) Appl. No.: 09/563,126

(22) Filed: May 2, 2000

(51) Int. Cl.[7] ..... E04H 1/00; E04H 14/00; E04H 3/00; E04H 5/00; E04H 6/00

(52) U.S. Cl. ..... 52/234; 52/79.7; 52/36.1; 52/34

(58) Field of Search ..... 52/234, 236.3, 52/79.8, 79.7, 236.4, 238.1, 36.1, 34; 297/229, 228.1

(56) References Cited

U.S. PATENT DOCUMENTS

| | | | | | |
|---|---|---|---|---|---|
| 2,858,579 | A | * | 11/1958 | Koelb | 52/234 |
| 3,623,284 | A | * | 11/1971 | Meyer | 52/34 |
| 4,173,024 | A | * | 10/1979 | Miller | 52/234 |
| 4,194,181 | A | | 3/1980 | Brundage | |
| 4,341,052 | A | * | 7/1982 | Douglass, Jr. | 52/234 |
| 4,358,171 | A | | 11/1982 | Christen | |
| D299,958 | S | | 2/1989 | Subtirelu | |
| 5,339,250 | A | | 8/1994 | Durbin | |
| 5,664,832 | A | * | 9/1997 | Stevens et al. | 297/225 |
| 5,676,422 | A | * | 10/1997 | White et al. | 297/225 |
| D387,939 | S | * | 12/1997 | Tedesco et al. | 297/218 |
| 5,775,033 | A | * | 7/1998 | Meehan | 52/33 |
| 5,806,260 | A | | 9/1998 | Quaintance | |
| 6,079,171 | A | * | 6/2000 | Burke | 52/234 |
| 6,128,875 | A | * | 10/2000 | Quaintance | 52/236.3 |
| 6,141,924 | A | * | 11/2000 | Quaintance | 52/236.3 |

OTHER PUBLICATIONS

USA Today, "Airline clubs pushing posh", p. 6E, Sep. 17, 1996, Final edition.*
USA Today, "Airline clubs: Coffee, tea and lots of privacy", p. 4B, Mar. 30, 1993, Final edition.*
USA Today, "Airline Clubs, a Respite From the Masses", Aug. 11, 1995, BC cycle.*

* cited by examiner

*Primary Examiner*—Carl D. Friedman
*Assistant Examiner*—Chi Q. Nguyen
(74) *Attorney, Agent, or Firm*—Michael A. Swift; Joy G. Taylor; Ice Miller

(57) ABSTRACT

The present invention is an accommodation for traveler's providing an inexpensive and safe option for respite while on a journey, comprising a building including a series of connected exterior walls defining a footprint of the building. The building includes a common interior hallway located adjacent at least one of the building's exterior walls. At least one door located in the building's exterior walls allows entrance into the building and more particularly into the building's common interior hallway. The building includes a plurality of rooms, each room having a door for entrance into the room from the common interior hallway. Each room's door is lockable from the inside by the traveler renting the room. Further, the rooms are arranged and constructed to accommodate at least one recliner chair, but no bed. The present invention further includes at least one bathroom in the building having a door with an inside lock. The bathroom's door provides access to the at least one bathroom from the common interior hallway. A control room is provided for checking the traveler into one of the plurality of rooms such that the traveler may use the at least one bathroom and the rooms at one recliner chair to relax, rest, and refresh for a few hours without having to incur the cost associated with a traditional hotel/motel, where a traveler must pay for a room for a minimum of one entire day.

18 Claims, 4 Drawing Sheets

TRAVELER'S ACCOMMODATION

BACKGROUND

The present invention is directed to a system and structure to accommodate travelers on a short term basis and more particularly to a novel "quick rest" concept where a traveler may check in to an accommodation containing at least one recliner chair and no bed on an hourly basis without having to incur the cost of traditional hotels/motels where a traveler must pay for an entire day irrespective of the length of the stay.

Millions of people travel the roads of America every day. From traveling salesmen to families driving on vacation, driving long distances is a modem fact of life. Hotels and motels are a common accommodation for travelers along today's highways and streets. If a traveler wishes to stay at such an establishment, he can do so by making reservations ahead of time, or by stopping in along the way and securing accommodations without reservations if vacant rooms are available. The traditional hotel/motel room contains one or more beds, a dresser, night stand, and typically a small table and chairs, and a private bathroom. The traveler must pay for use of the room on a daily basis.

Many travelers get tired or sleepy while driving. Unfortunately, because of the relatively high cost of having to pay for a hotel/motel room at a full day's rate, travelers will frequently continue to drive while tired or drowsy, rather than stop and get a few hours' rest. Alternately, the tired traveler may decide to stop by the roadside or at a rest stop to catch a short nap in his vehicle. However, in today's world, that particular option can be dangerous as people have been robbed and even killed while attempting to get a few hours' rest at a road side rest stop.

Thus, millions of people each year drive while sleepy or tired. In fact, the National Highway Traffic Safety Administration attributes sleepiness as the cause of over 100,000 crashes each year. Thousands die on U.S. highways each year because someone fell asleep at the wheel.

Thus, there exists a need for a new type of accommodation which would provide tired or sleepy travelers an inexpensive option to the traditional hotel/motel and therefore encourage such travelers to get needed rest when on a trip. Such an accommodation not only needs to be inexpensive, but must provide for a safe place where a traveler may acquire a few minutes' or even a few hours' rest and relaxation.

SUMMARY

The present invention addresses the deficiencies associated with traditional hotel/motel establishments by providing an inexpensive and safe accommodation where a traveler may rent a room for a few hours to rest and/or sleep. The rates are relatively inexpensive because overhead is low. Rooms are only equipped with one or more comfortable recliner chairs and no beds. Private bathrooms are not provided for each room. Rather, the present invention provides for at least one common bathroom to be used by the patrons of the plurality of rooms thus reducing overhead costs. Also, because no beds are provided, the costs involved in providing and laundering bed linens is avoided.

More particularly, the present invention is an accommodation for travelers providing an inexpensive and safe option for respite while on a journey, comprising a building including a series of connected exterior walls defining a footprint of the building. The building includes a common interior hallway located adjacent at least one of the building's exterior walls. At least one door located in the building's exterior walls allows entrance into the building and more particularly, into the building's common interior hallway. The building includes a plurality of rooms, each room having a door for entrance into the room from the common interior hallway. Each room's door is lockable from the inside by the traveler renting the room. Further, the rooms are arranged and constructed to accommodate at least one recliner chair, but no bed. The present invention further includes at least one bathroom in the building having a door with an inside lock. The bathroom's door provides access to the at least one bathroom from the common interior hallway. The present invention further includes a control room for checking the traveler into one of the plurality of rooms such that the traveler may use the at least one bathroom and the room's at least one recliner chair to relax, rest, and refresh for a few hours without having to incur the costs associated with a traditional hotel/motel, where a traveler must pay for a room for a minimum of one entire day.

According to another embodiment of the present invention, a method for providing an accommodation for travelers that is an inexpensive option for respite while on a journey comprises the steps of: providing an accommodation for travelers having a building including a series of connected exterior walls defining a footprint of the building, a common interior hallway located within the building adjacent at least one of the building's exterior walls, at least one door located in the building's exterior walls to allow entrance and egress into the common interior hallway, a plurality of rooms located in the building, each room having a door for entrance into the room from the common interior hallway only, each door having a lock, at least one recliner chair located in each room wherein the rooms are arranged and constructed to accommodate the at least one recliner chair, but no bed, at least one bathroom located in the building to service more than one room, the at least one bathroom being accessible from the common interior hallway only, and a control room for checking the traveler into one of the plurality of rooms; and checking and traveler into the accommodation for travelers.

The present invention provides an inexpensive, and safe option to the traditional hotel/motel. Driving travelers can grab a few hours for rest and relaxation, paying only for the time they use the room of the present invention. Thus, tired and sleepy drivers will be encouraged to utilize the present invention. It is anticipated that as more and more traveler's accommodations of the present invention become available, there will be reduction in the incidents of accidents caused by drowsy drivers.

These and other advantages and features of the present invention shall hereinafter appear, and for the purposes of illustration, but not limitation, exemplary embodiments of the present invention shall hereinafter be described.

DETAILED DESCRIPTION

Structure

Figure 1:
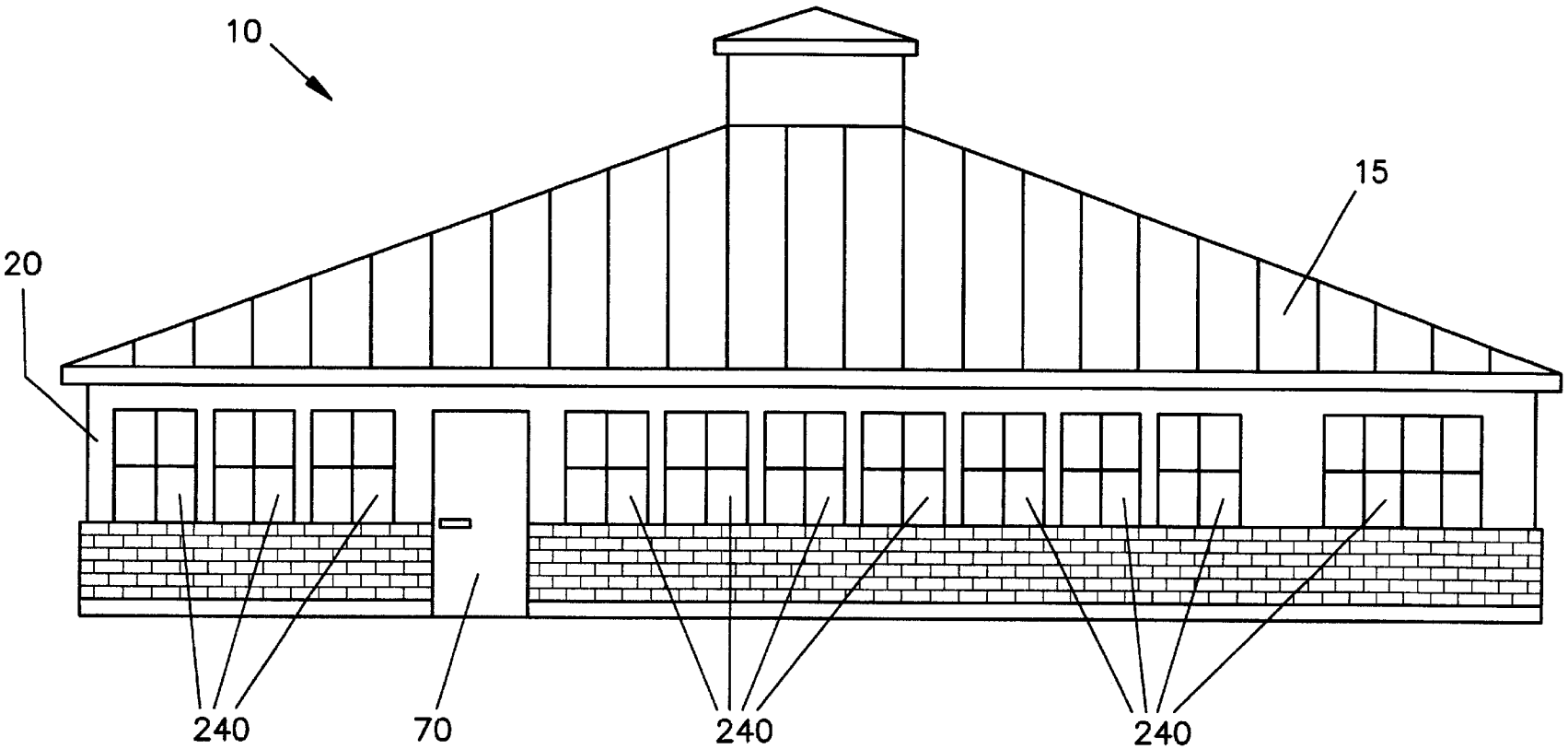
FIG. 1 is a side elevation of building in accordance with the present invention.

In accordance with the present invention, an accommodation for travelers is provided as shown in FIG. 1 and FIG.

Figure 2:
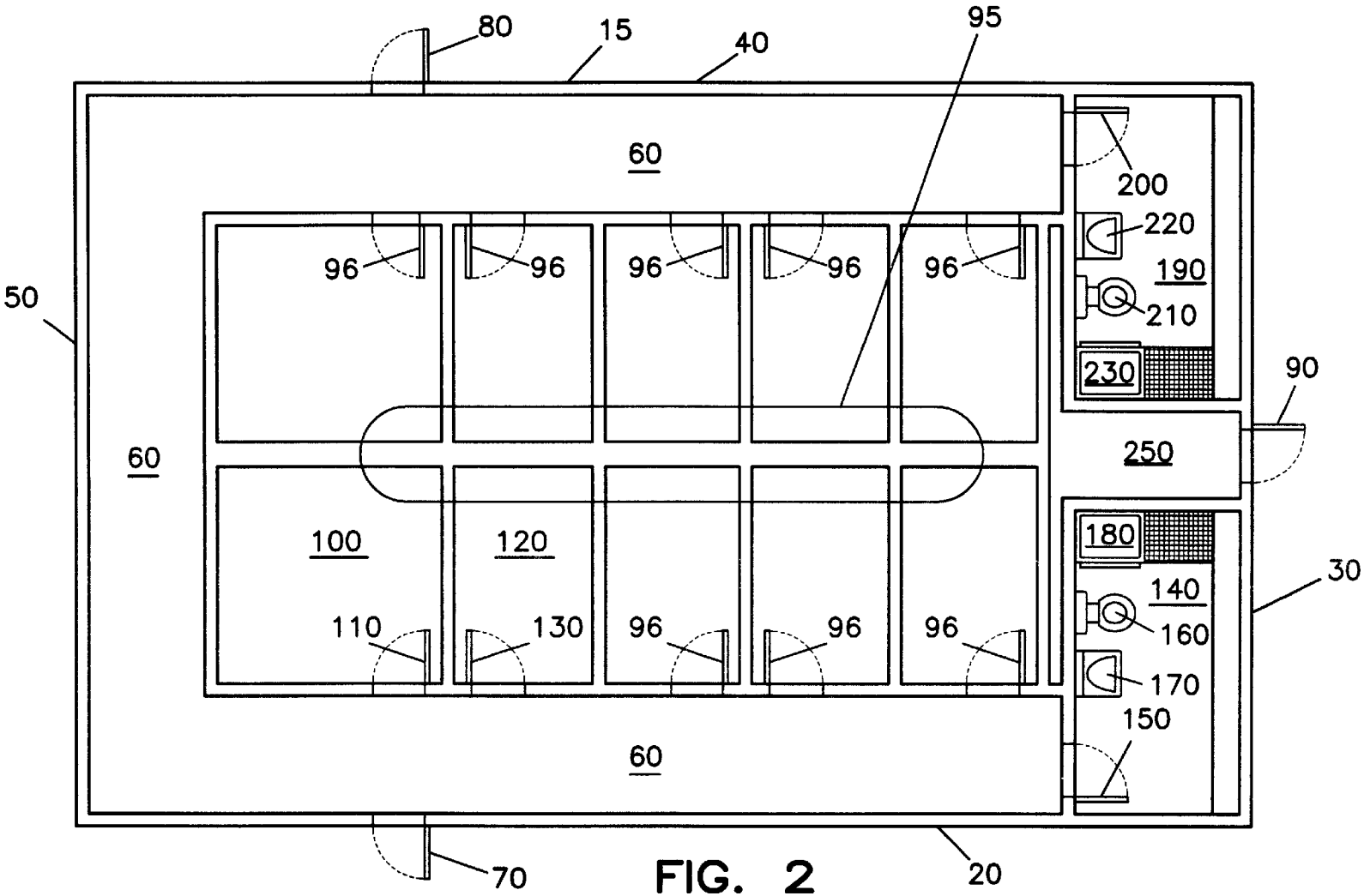
FIG. 2 is a layout of the floor plan of one embodiment of the present invention.

2 and is generally indicated by the numeral 10. Referring to FIG. 2, the traveler's accommodation includes a building 15 having a series of connected exterior walls 20, 30, 40, 50. Running along the inside of the exterior walls 20, 40, and 50, is a common interior hallway 60. At least one door 70, located in exterior wall 20, provides access into the common interior hallway 60 from the exterior of building 15. Referring to FIG. 1, the exterior walls may also include a plurality of windows 240 to provide natural light and visibility into the common interior hallway 60.

As shown in FIG. 2, a second door 80, located in exterior wall 40 may also be provided to access the common interior hallway 60. Although not shown in any figure, the present invention anticipates locating a door in exterior wall 50 or multiple doors in any of the exterior walls for entrance into the common interior hallway 60.

Figure 4:
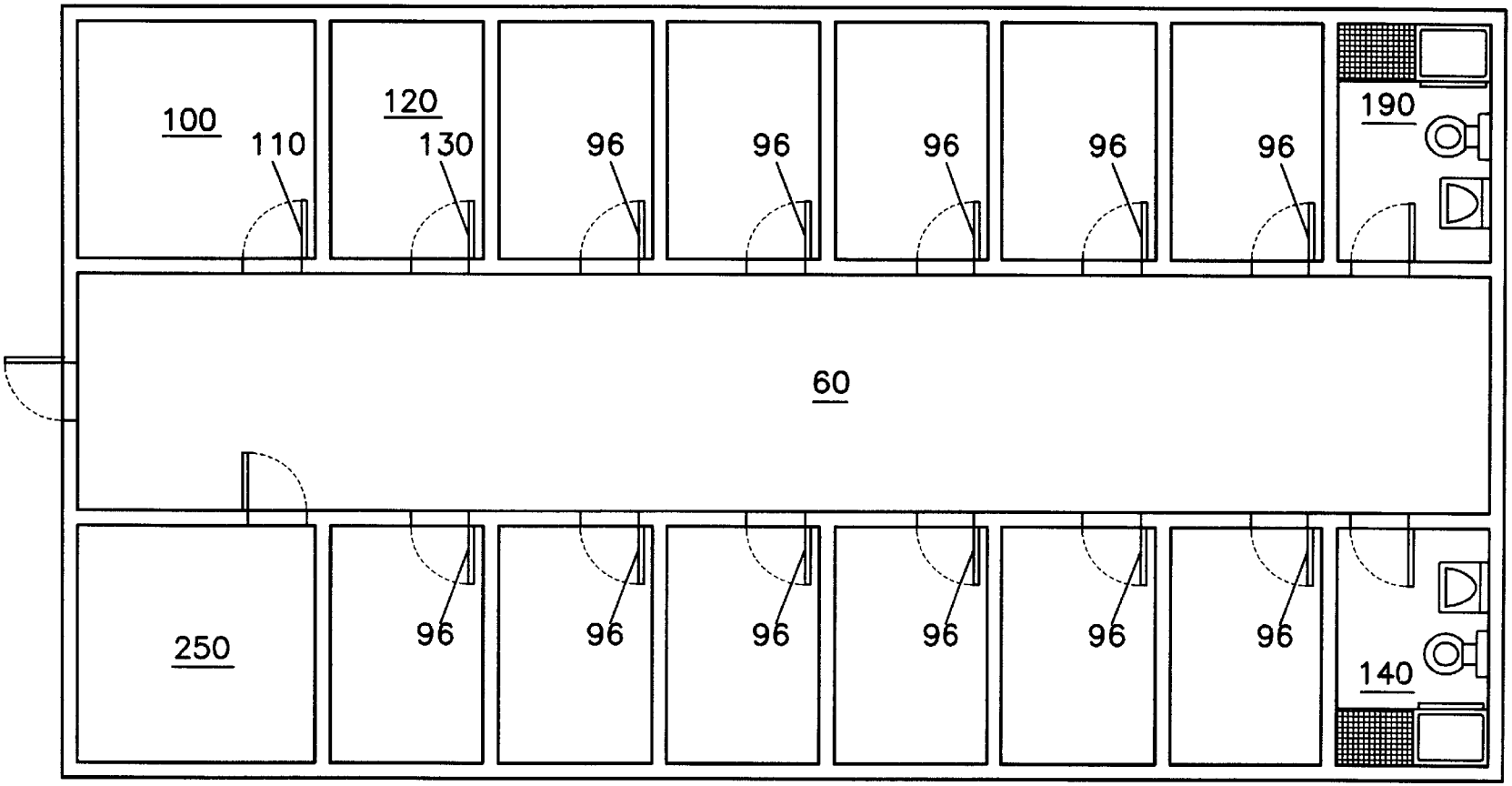
FIG. 4 is a layout of the floor plan of alternate embodiment of the present invention.

Referring to FIG. 4, the present invention may be arranged and constructed whereby the common interior hallway 60 is centrally located between two rows of rooms. Rooms open only into common interior hallway 60 for example, room 100 accesses common interior hallway 60 through door 110. Access to the at least one bathroom is provided at one end of common interior hallway 60. Control room 250 is located at the other end of common interior hallway 60. Access from the outside to common interior hallway 60 may be provided at either end or at both ends of common interior hallway 60. In yet another embodiment of the present invention (not shown in any figure), instead of two rows of rooms as shown in FIG. 4, only a single row of rooms is provided, each room again opening into the common interior hallway only. Access to the at least one bathroom from the common interior hallway would be provided at one end of the common interior hallway while access to the control room may be provided at the other end of the common interior hallway. Alternately, the control room may be located in an entirely different structure remote from the building.

Referring to FIG. 2, the present invention further comprises a plurality of individual rooms 95 located in building 15, each room having a door 96 with a lock (not shown). For example, door 110 opens into room 100 from common interior hallway 60. Each door's lock can be either mechanical whereby, for example, a traditional key is used to unlock the door, or electronic, whereby, for example, a key card is used to unlock the door as is common in the industry. Each of the plurality of rooms is equipped with at least one comfortable recliner chair rather than a bed or a cot.

The traveler's accommodation of the present invention further includes at least one bathroom. The embodiment of FIG. 2 depicts a traveler's accommodation 10 with two bathrooms 140, 190. Bathroom 140 includes a single lockable door 150 that provides access to bathroom 140 from common interior hallway 60. Bathroom 140 also includes at toilet 160, sink 170, and shower 180. Likewise, a second bathroom 190 is shown in FIG. 2 and includes a toilet 210, sink 220, and shower 230. Access into second bathroom 190 from common interior hallway 60 is provided via door 200. The bathroom and/or multiple bathrooms may also be equipped with a urinal and where appropriate, the shower can be eliminated and/or replaced with a tub/shower unit.

The present invention further includes a control room wherein worker or workers check in travelers into the plurality of rooms so that the checked-in travelers may use the at least one bathroom and the rooms at least one recliner chair to relax, rest, and refresh for a few hours without having to incur the costs associated with traditional hotel/motel where a traveler must pay for a room for a minimum of one entire day. Referring to FIG. 2, the control room 250 may be located within the building 15. FIG. 2 shows control room 250 is accessed via door 90. However, the traveler's accommodation may be arranged and constructed such that the control room 250 is accessed from the common interior hallway 60 as shown in for example FIG. 4. Alternately (not shown), the control room may be accessed from both the outside and the common interior hallway. In yet another embodiment of the present invention, the control room may also be located in an entirely different structure (not shown) attached to or separate from building 15.

The present invention may also include a utility room for the storage of supplies and maintanance items. The utility room may be located within building 15 and essentially replace one of the plurality of rooms 95 for such purpose. Alternately, control room 250 could be arranged and constructed to serve the dual purpose of being a control room and also being a utility room. If the control room is located in a structure separate from the building, the utility room may also be located within that structure.

The traveler's accommodation of the present invention will be equipped with modern safety and convenience features. For example, the at least one bathroom may include means for indicating to travelers in the common interior hallway 60 and/or a worker in control room 250 that the bathroom is occupied. Such means could include, but is not limited to, a slide lock in the bathroom's door whereby when the door is locked from inside the at least one bathroom, a sign displaying the "Occupied" designation or similar message could be displayed on the outside of the at least one bathroom's door, thus being visible from the common interior hallway 60. In the alternative, a light could be provided in the common interior hallway and in close proximity to the at least one bathroom's door that would be lit when the door is locked. The door lock could also be constructed to complete a circuit when locked to show travelers in the plurality of rooms and/or a worker in the control room when the bathroom is occupied.

Alternately, travelers could be issued key cards with electronic strips when they check in as is common in the industry. Such cards would not only provide access to one of the plurality of rooms, but could also be programed to allow access into building 15 through door 70, 80 for example. Further, such a key card system could also be programmed to allow checked-in travelers access to the at least one bathroom 140 or 190. As the traveler accesses the at least one bathroom 140 or 190 using the key card, travelers in the plurality of rooms 95 and/or in the common interior hallway 60 would be alerted that the bathroom is occupied. The occupied bathroom would not be accessible by other key cards until the occupant opened the at least one bathroom's door from the inside of the bathroom and exited therefrom.

In another embodiment of the present invention, the common interior hallway will not only be well lighted, but means for monitoring the common interior hallway 60 from the control room 250 is provided. Such means include, but is not limited to, video monitoring cameras strategically placed within the common interior hallway 60, that provide real time viewing of the common interior hallway from control room 250 as well as storage and retention of taped events as is common in the art.

The present invention further includes means for alerting a worker in the control room 250 and/or local authorities such as law enforcement and/or fire departments in the event of an emergency. Such means could include, but is not limited to, a common "panic button" that when actuated results in a visual and/or auditable signal in the control room 250 and/or local law enforcement facilities and/or fire department facilities. Panic buttons could be located in the at least one bathroom 140, 190, plurality of rooms 95, and/or common interior hallway 60. Alternatively, the control room 250 could also be equipped to alert civil authorities in the event of an emergency. This could be accomplished in any manner common in the art for providing such alerts. For example, systems tied to phone lines, direct links with civil authorities, and/or links to civil authorities through third party monitoring an alarm system companies could be utilized.

Figure 3:
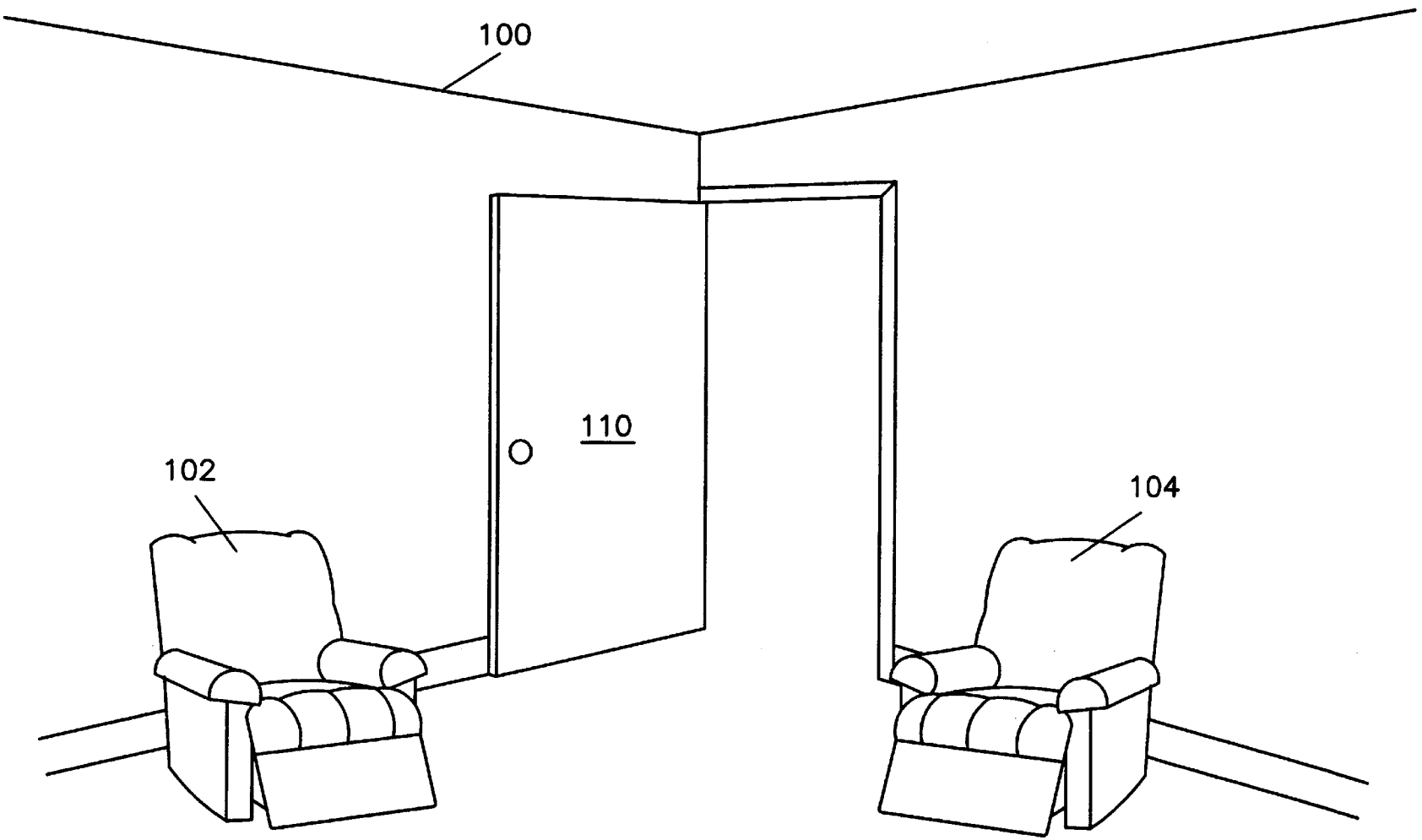
FIG. 3 is a perspective view of a room with two recliner chairs in accordance with the present invention.

The present invention may also include a plurality of rooms having a combination of room sizes whereby the rooms are sized according to the number of recliner chairs the room is arranged and constructed to hold. For example, referring to FIG. 2 and FIG. 3, room 100 is sized at about 9 feet by 10 feet and is arranged and constructed to hold at least two recliner chairs 102, 104. Thus, room 100 may be utilized by more than one traveler as is the case with a husband and wife traveling together. In contrast, room 120 is sized at about 8 feet by 10 feet and is arranged and constructed to hold a single recliner chair. In the case of both room 120 and room 100, enough space is provided to allow occupant or occupants to move around comfortably in the room and fully utilize the fully reclined position of the recliner chair.

The present invention may also include means for ensuring that the recliner chair remains sanitary for use by travelers. Such means would include any approach to ensuring that this type of furniture remains sanitary as is customary in the art. For instance, each recliner chair could be provided with a disposable protective cover that could be easily pulled over the recliner chair or a portion thereof, such as the headrest, either before a traveler uses the recliner chair or after the traveler has used the recliner chair. In another embodiment, the cover may comprise a reusable material that could be stripped from the recliner chair after each use and laundered. Such an embodiment of the cover could be reused. Further, each of the plurality of rooms could be provided a cleaning/disinfect material as is common in the art, which could be applied to the recliner chair, especially in the area of the headrest, after each use.

The present invention also involves a method of providing travelers a convenient, safe and economical option to hotels and motels for acquiring a few hours' relaxation while on a journey. This method comprises the steps of providing an accommodation for travelers having a building including a series of connected exterior walls defining a footprint of the building. The provided accommodation for travelers further comprises a common interior hallway located within the building at least partially adjacent one of the building's exterior walls, at least one door located in the exterior walls to allow entrance into the building to the common interior hallway. The traveler's accommodation also includes a plurality of rooms located in the building, each room having a door for entrance into the room from the common interior hallway only. The provided accommodation for travelers further includes at least one recliner chair located in each room wherein the rooms are arranged and constructed to accommodate at least one recliner chair, but not a bed, at least one bathroom located in the building, the at least one bathroom having a door having an inside lock, the door providing access to the at least one bathroom from the common interior hallway only. A control room for checking travelers into the plurality of rooms is also provided as a features of the present invention.

The second step of the method of use of the present invention is checking the traveler into the accommodation for travelers. The checking in step further comprises explaining the features of the accommodation for travelers to the traveler, obtaining proof of the identity from the traveler being checked-in, copying the proof of identity, recording the date and time the traveler checked-in, obtaining payment up-front from the traveler for at least one hour's use of the room, and arranging for payment in the event that the traveler exceeds the time payed for.

In yet another embodiment of the present invention, the method further comprises providing means to enter the building's common interior hallway from the exterior of the building for checked-in travelers only, providing means for alerting an emergency from each of the plurality of rooms, the common interior hallway, and the at least one bathroom in the event of an emergency, providing means for alerting local civil authorities in the event of an emergency, and means for monitoring the common interior hallway and exterior of the building.

As is apparent from the above-description of the present invention and the claims appended below, the present invention solves certain critical deficiencies of traditional hotel/motel establishments. Budget minded travelers driving long distance often just need a few minutes or hours rest to overcome drowsiness and thus continue their drive in a safe and alert manner. Such drivers would be more inclined to use the present invention when they are drowsy or tired to refresh rather than a traditional hotel/motel establishment because of the convenience and costs saving features of the present invention. The drowsy driver will be able to rent a room for essentially the time they will use it rather than in whole day increments as is the case with traditional hotels/motels.

The present invention still offers the opportunity to nap, shower and otherwise use the toilet facilities. However, both capital costs and operating costs are substantially reduced in comparison to traditional hotel and motel establishments through the present invention's use of recliner chairs rather than beds and other typical hotel room furnishings, and shared restroom facilities, rather than a dedicated bathroom for each room as is currently standard in the industry. Thus, the proprietors of the present invention will be able to offer accommodations at a much reduced rate. Travelers will continue their journeys refreshed and alert thereby eliminating the possibility of an accident resulting from a drowsy or tired driver.

Other advantages and features are readily apparent and may be found and realized and various modifications may be made by those skilled in the art, it is understood that the present invention is not be limited to the details given above, but rather may be modified within the scope of the appended claims.

We claim:

1. An accommodation for travelers providing an inexpensive option for respite while on a journey, comprising:

a. a building including a series of connected exterior walls defining a footprint of the building;

b. a common interior hallway located within the building adjacent at least one of the building's exterior walls;

c. at least one door located in the building's exterior walls to allow entrance into the building to the common interior hallway;

d. a plurality of rooms located in the building, each room having a door for entrance into the room from the common interior hallway only, each door having a lock;

e. at least one recliner chair, but not a bed, located in each room wherein the rooms are arranged and constructed to accommodate the at least one recliner chair;

f. at least one bathroom located in the building, the at least one bathroom having a door with an inside lock, the door providing access to the at least one bathroom only from the common interior hallway; and g. a control room for checking the travelers into one of the plurality of rooms so that travelers may use the at least one bathroom and the at least one recliner chair to relax, rest and refresh for a few hours without having to incur the costs associated with a traditional hotel/motel where the traveler must pay for a room for a minimum of one entire day.

2. The accommodation for travelers of claim 1 wherein the plurality of rooms further comprise at least one room that is sized to allow a single recliner chair, and at least one room that is sized to allow at least two recliners chairs.

3. The accommodation for travelers of claim 1 wherein the at least one bathroom further includes means for indicating to travelers in the common interior hallway and the worker in the control room that the at least one bathroom is occupied.

4. The accommodation for travelers of claim 1 further comprising means for limiting access to the building to travelers who have been checked-in only.

5. The accommodation for travelers of claim 1 wherein the exterior walls include a plurality of windows.

6. The accommodation for travelers of claim 1 wherein the plurality of rooms includes means for alerting the control room in the event of an emergency.

7. The accommodation for travelers of claim 1 wherein the at least one bathroom includes means for alerting the control room in the event of an emergency.

8. The accommodation for travelers of claim 1 wherein the common interior hallway includes means for alerting the control room in the event of an emergency.

9. The accommodation for travelers of claim 1 further comprising means for monitoring the common interior hallway and the exterior of the building.

10. The accommodation for travelers of claim 1 further including means for alerting public authorities such as police and fire departments in the event of an emergency.

11. The accommodation for travelers of claim 1 wherein the at least one recliner chair includes a disposable protective cover so that travelers will always have a clean surface covering the at least one recliner as travelers use the at least one recliner to rest and relax.

12. The accommodation for travelers of claim 1 wherein the at least one recliner chair is cleaned and disinfected periodically to ensure sanitary conditions for travelers using the at least one recliner.

13. The accommodation for travelers of claim 1 wherein the at least one bathroom includes at least one toilet, at least one sink, at least one mirror, and at least one shower.

14. The accommodation for travelers of claim 1 wherein the at least one bathroom includes at least one toilet, at least one urinal, at least one sink, at least one mirror, and at least one shower.

15. The accommodation for travelers of claim 1 further comprising at least one utility room located in the building.

16. The accommodation for travelers of claim 3 further comprising means for indicating to travelers in the plurality of rooms that the at least one bathroom is occupied.

17. A method of providing travelers a convenient, safe and economical option to hotels and motels for acquiring a few hours of relaxation while on a journey comprising of steps:

providing an accommodation for travelers comprising a building including a series of connected exterior walls defining a footprint of the building, the building having a common interior hallway located within the building adjacent at least one of the exterior walls, at least one door located in at least one exterior wall to allow entrance into the building to the common interior hallway, a plurality of rooms located in the building, each room having a door for entrance into the room from the common interior hallway only, each door having a lock, at least one recliner chair, but not a bed, located in each room wherein the rooms are arranged and constructed to accommodate at least one recliner chair, at least one bathroom located in the building, the at least one bathroom having a door with an inside lock, the door providing access to the at least one bathroom from the common interior hallway only, and a control room wherein a worker may be located to check travelers into one of the plurality of rooms so that checked-in travelers may use the at least one bathroom and the at least one recliner chair to relax, rest, and refresh for a few hours without having to incur the costs associated with a traditional hotel/motel where a traveler must pay for a room for a minimum of one entire day; and checking the traveler into the accommodation.

18. The method of claim 17 further comprising the steps:

providing means for checked-in travelers only to enter the building's common interior hallway from the exterior of the building;

providing means for alerting the control room from each of the plurality of rooms, common interior hallway, and at least one bathroom in the event of an emergency;

providing means for alerting local civil authorities in the event of an emergency;

monitoring the common interior hallway and exterior of the building; and providing means to ensure that the at least one recliner remains clean for travelers as they use the at least one recliner to rest and relax.

* * * * *